US009595188B2

(12) United States Patent
Kim

(10) Patent No.: US 9,595,188 B2
(45) Date of Patent: Mar. 14, 2017

(54) WIRELESS CONTROL APPARATUS INCLUDING COMMUNICATION MODULE AND CONTROL SYSTEM INCLUDING THE SAME

(71) Applicant: LG Innotek Co., Ltd., Seoul (KR)

(72) Inventor: Dae Hun Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/902,525

(22) PCT Filed: Jul. 4, 2014

(86) PCT No.: PCT/KR2014/006013
§ 371 (c)(1),
(2) Date: Dec. 31, 2015

(87) PCT Pub. No.: WO2015/002501
PCT Pub. Date: Jan. 8, 2015

(65) Prior Publication Data

US 2016/0379481 A1 Dec. 29, 2016

(30) Foreign Application Priority Data

Jul. 4, 2013 (KR) ..... 10-2013-0078496

(51) Int. Cl.
*G08C 17/02* (2006.01)

(52) U.S. Cl.
CPC ..... *G08C 17/02* (2013.01); *G08C 2201/42* (2013.01)

(58) Field of Classification Search
CPC ..... G08C 17/02; G08C 23/04; G08C 17/00; G08C 2201/92; G08C 2201/21; G08C 2201/30; G08C 2201/50; G08C 19/00
(Continued)

(56) References Cited

U.S. PATENT DOCUMENTS 7,055,759 B2 * 6/2006 Wacker ..... F24F 11/0086 165/201
7,083,109 B2 * 8/2006 Pouchak ..... G05D 23/1905 236/1 E
(Continued)

FOREIGN PATENT DOCUMENTS

EP 1933288 A2 6/2008
JP 06223977 A 8/1994
(Continued)

OTHER PUBLICATIONS

International Search Report in International Application No. PCT/KR2014/006013, filed Jul. 4, 2014.
(Continued)

*Primary Examiner* — Mark Blouin
(74) *Attorney, Agent, or Firm* — Saliwanchik, Lloyd & Eisenschenk

(57) ABSTRACT

Disclosed are a wireless control apparatus including a communication module and a control system including the same. The wireless control apparatus includes a module unit to generate a control signal for controlling an operation of an electronic appliance; and a communication module detachably coupled to the module unit to receive the control signal generated from the module unit and transmit the received control signal to the electronic appliance through a communication network.

20 Claims, 15 Drawing Sheets

(58) Field of Classification Search
USPC ..... 340/12.22
See application file for complete search history.

(56) References Cited

U.S. PATENT DOCUMENTS

| | | | | |
|---|---|---|---|---|
| 7,259,953 | B2 * | 8/2007 | Salerno | G05B 19/0423 361/171 |
| 8,117,587 | B1 * | 2/2012 | Testardi | G06F 8/447 717/100 |
| 2002/0110228 | A1 | 8/2002 | Silverman et al. | |
| 2004/0152460 | A1 | 8/2004 | La et al. | |
| 2005/0224589 | A1 | 10/2005 | Park et al. | |
| 2007/0271500 | A1 | 11/2007 | Theophil et al. | |
| 2008/0143551 | A1 | 6/2008 | Otsuka et al. | |
| 2010/0026512 | A1 * | 2/2010 | Wang | G08C 23/04 340/12.22 |
| 2010/0118148 | A1 | 5/2010 | Lee | |
| 2010/0176730 | A1 | 7/2010 | Lee et al. | |
| 2011/0029066 | A1 | 2/2011 | Gilad et al. | |
| 2011/0102271 | A1 | 5/2011 | Hung et al. | |
| 2011/0264245 | A1 * | 10/2011 | Lim | H04L 12/12 700/90 |
| 2011/0312384 | A1 | 12/2011 | Youn | |

FOREIGN PATENT DOCUMENTS

| | | | |
|---|---|---|---|
| JP | 2003317528 | A | 11/2003 |
| JP | 2004032235 | A | 1/2004 |
| KR | 1020100052985 | A | 5/2010 |
| WO | WO-2009103587 | A1 | 8/2009 |

OTHER PUBLICATIONS

Extended European Search Report Dated Dec. 15, 2016 in European Application No. 14820240.1.

* cited by examiner

WIRELESS CONTROL APPARATUS INCLUDING COMMUNICATION MODULE AND CONTROL SYSTEM INCLUDING THE SAME

CROSS-REFERENCE TO RELATED APPLICATION

This application is the U.S. national stage application of International Patent Application No. PCT/KR2014/006013, filed Jul. 4, 2014, which claims priority to Korean Application No. 10-2013-0078496, filed Jul. 4, 2013, the disclosures of each of which are incorporated herein by reference in their entirety.

TECHNICAL FIELD

The embodiment relates to a control apparatus including a communication module, and more particularly, to a wireless control apparatus in which a communication module is detachably installed and a control system including the same.

BACKGROUND ART

Generally, a home network system includes electronic appliances including various home appliances, lighting appliances and sensors.

In general, users manually manipulate a switch connected to an electronic appliance through a cable in order to turn on or off the electronic appliance. In this case, the patient, the senior citizen or the infirm who cannot move freely, or children who cannot reach the switch may feel inconvenience when turning on or off the electronic appliance.

Recently, in order to solve the inconvenience, each appliance has been controlled through a wireless control apparatus such as a remote controller, a smart phone, a gateway or a dimmer.

However, as various electronic appliances exist, wireless communication schemes applied to the electronic appliances are various. Thus, requests for selecting one among wireless communication schemes, such as ZigBee, Wi-Fi and Bluetooth, in consideration of the speed, distance and consumed power have been increased.

In addition, since a communication module for receiving, processing and transmitting a user instruction is integrated with a home electronic appliance, a lighting appliance a sensor or a control apparatus, when trouble of a power supply unit and/or trouble of a main module occur(s) in an appliance, the entire appliance including the communication module must be exchanged.

DISCLOSURE

Technical Problem

The embodiment provides a wireless control apparatus in which a communication module is detachably installed and a control system including the same.

Meanwhile, the technical objects accomplished by the embodiments may not be limited to the above object, and other technical objects of the embodiment will be clearly understood by those skilled in the art from the following description.

Technical Solution

According to the embodiment, there is provided a wireless control apparatus including: a module unit to generate a control signal for controlling an operation of an electronic appliance; and a communication module detachably coupled to the module unit to receive the control signal generated from the module unit and transmit the received control signal to the electronic appliance through a communication network.

The communication module transmits the control signal to the electronic appliance through a gateway.

The module unit includes a dimmer to control the electronic appliance including a lighting appliance, or at least one of a remote controller and a wall pad to control the electronic appliance including at least one of a home electronic appliance and various sensors.

The communication module includes a housing having an inner space; and a module substrate disposed in the inner space of the housing and on which a wireless communication chip is mounted.

The module substrate includes an antenna unit; a wireless communication unit; and an interface unit, and wherein the interface unit makes contact with an interface of the module to receive the control signal, the wireless communication unit receives the received control signal and generates an output signal to be transmitted to the electronic appliance based on the received control signal, and the antenna unit transmits the output signal generated from the wireless communication unit to the electronic appliance.

The housing includes a first receiving part to receive the antenna unit; and a second receiving part to receive the wireless communication unit, and wherein the interface unit is inserted into an inserting hole provided in the module unit protruding out of the housing, and the first receiving part receiving the antenna unit protrudes out of the electronic appliance when the interface unit is inserted into the inserting hole of the module unit.

The interface unit includes a plurality of pins making contact with an interface of the module unit to communicate with the module unit, the pins are divided into at least first and second pin groups, and the module substrate includes a recess to allow the first and second pin groups to be spaced apart from each other.

The pins are divided into the first and second pin groups according to kinds of signals transmitted through each pin.

The number of pins of the first pin group is different from the number of pins of the second pin group.

A ground pin is disposed at a center of the pins.

The antenna unit is opposite to the interface unit while interposing the wireless communication unit therebetween.

Meanwhile, according to the embodiment, there is provided a network system including: at least one electronic appliance that receives a control signal through a communication network and is driven by the received control signal; and a wireless control apparatus to transmit the control signal to the electronic appliance through the communication network, wherein a first communication module is detachably coupled to the wireless control apparatus to determine the communication network and transmit the control signal to the electronic appliance, and a second communication module is detachably coupled to the electronic appliance to determine the communication network and receive the control signal transmitted through the wireless control apparatus.

The network system further includes a gateway disposed between the electronic appliance and the wireless control apparatus to receive the control signal transmitted through the wireless control apparatus and to transmit the received control signal to the electronic appliance, wherein a third communication module is detachably coupled to the gateway to determine the communication network.

A type of the communication network used between the wireless control apparatus and the gateway is different from a type of the communication network used between the gateway and the electronic appliance.

The electronic appliance includes at least one of a lighting apparatus, a sensor module and an electronic appliance.

Each of the first to third communication modules includes a housing having an inner space; and a module substrate disposed in the inner space of the housing and on which a wireless communication chip is mounted, and wherein the module substrate includes: an antenna unit; a wireless communication unit; and an interface unit.

The housing includes a first receiving part to receive the antenna unit; and a second receiving part to receiving the wireless communication unit, and wherein the interface unit is inserted into an inserting hole provided in an object protruding out of the housing, and the first receiving part to receive the antenna unit protrudes out of the object when the interface unit is inserted into the inserting hole of the module unit.

The interface unit includes a plurality of pins which makes contact with an interface of the object to communicate with the object, the plurality of pins is divided at least into first and second pin groups, and the module substrate has a recess to allow the first pin group to be spaced apart from the second pin group.

The first and second pin groups are distinguished from each other according to kinds of signals transmitted through the pins.

The number of pins of the first pin group is different from the number of pins of the second pin group.

A ground pin is disposed at a center of the pins.

The antenna unit is opposite to the interface unit while interposing the wireless communication unit therebetween.

Advantageous Effects

According to the embodiment, wireless communication modules installed to an electronic appliance including a home electronic appliance, a lighting device and a sensor and a wireless control apparatus which constitute a network system are detachably formed, so that the communication modules may be detached and preserved when the main modules included in the electronic appliance and the control apparatus are exchanged, thereby reducing the cost.

In addition, the interface units of a dongle type are formed on outer surfaces of the various electronic appliances and the control apparatus to allow the communication modules to be inserted into each interface unit, so that the communication modules are easily coupled.

According to the embodiment, one of various wireless communication schemes (such as ZigBee, Wi-Fi and Bluetooth) is enabled to be selectively implemented in the wireless communication unit of the communication module, so that an optimal wireless communication scheme may be selected in consideration of speed/distance/consumed power and the wireless communication scheme applied to the control object. Thus, effective data transmission/reception and control may be achieved.

BEST MODE

Mode for Invention

Figure 1:
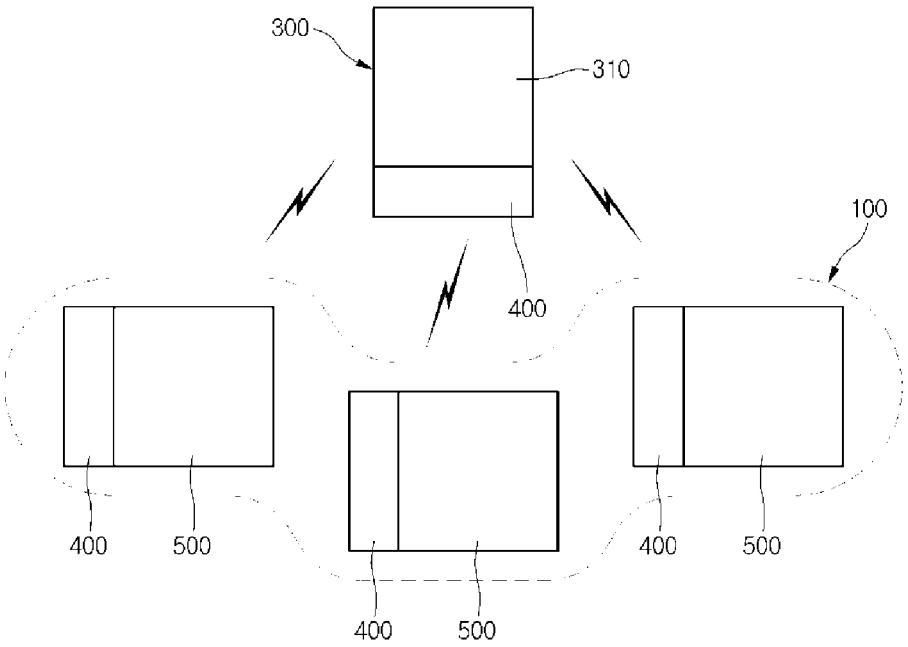
FIG. 1 is a view showing a network system according to the first embodiment.

Hereinafter, embodiments will be described in detail with reference to accompanying drawings so that those skilled in the art can easily work with the embodiments. However, the embodiments may have various modifications. The thickness and size of each layer shown in the drawings may be exaggerated, omitted or schematically drawn for the purpose of convenience or clarity. In addition, the size of elements does not utterly reflect an actual size. The same reference numbers will be assigned the same elements throughout the drawings.

In the following description, when a predetermined part "includes" a predetermined component, the predetermined part does not exclude other components, but may further include other components if there is a specific opposite description.

The thickness of each layer shown in the drawings may be enlarged for the purpose of convenience or clarity. In addition, the size of elements does not utterly reflect an actual size. The same reference numbers will be assigned the same elements throughout the drawings. In the description of the embodiments, it will be understood that, when a layer, a film, a region or a plate is referred to as being "on" or "under" another layer, another film, another region, or another plate, it can be "directly" or "indirectly" on the other layer, film, region, plate, or one or more intervening layers may also be present. Such a position of the layer has been described with reference to the drawings.

The embodiment provides a network system including a communication module detachably coupled to an electronic appliance such as a lighting module or a control apparatus for controlling the electronic appliance.

Hereinafter, the network system will be described with reference to FIGS. 1 to 5.

Figure 2:
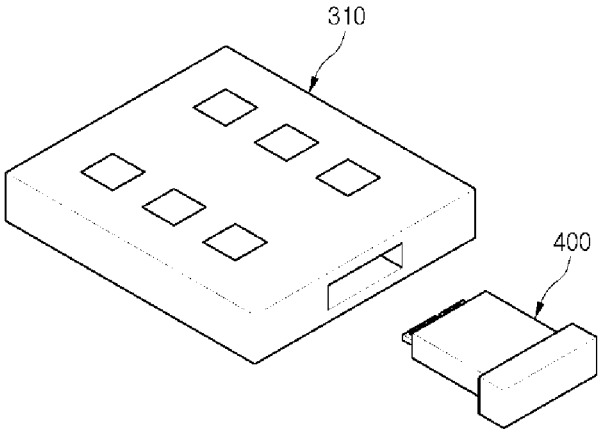
FIG. 2 is a perspective view showing the control apparatus of FIG. 1.
Figure 3:
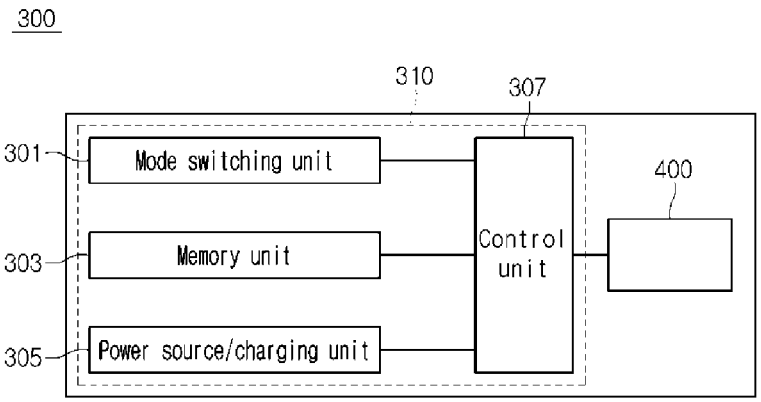
FIG. 3 is a view showing a configuration of the control apparatus of FIG. 1.
Figure 4:
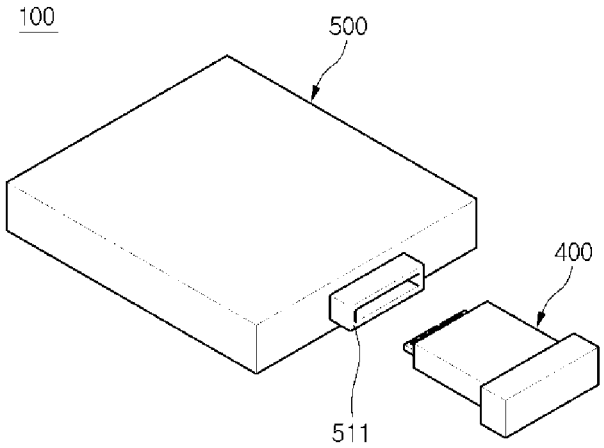
FIG. 4 is a perspective view showing the electronic appliance of FIG. 1.
Figure 5:
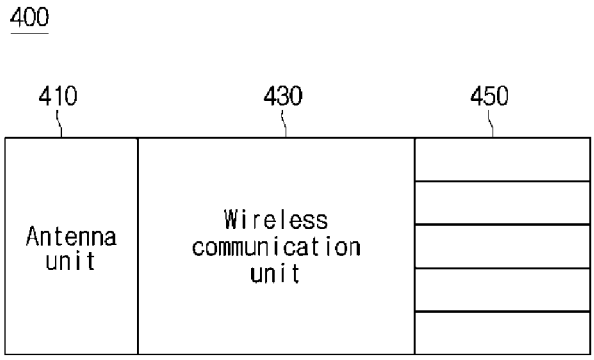
FIG. 5 is a view showing a configuration of the communication module of FIG. 4.

FIG. 1 is a view showing a network system according to the first embodiment. FIG. 2 is a perspective view showing the control apparatus of FIG. 1. FIG. 3 is a view showing a configuration of the control apparatus of FIG. 1. FIG. 4 is a perspective view showing the electronic appliance of FIG. 1. FIG. 5 is a view showing a configuration of the communication module of FIG. 4.

Referring to FIG. 1, the network system according to the embodiment includes a wireless control apparatus 300 and an electronic appliance 100.

The wireless control apparatus 300 is connected to a plurality of electronic appliances 100 through a communication network.

At least one electronic appliance 100 may be included and in the embodiment, three electronic appliances 100 are depicted.

In this case, the electronic appliance 100 may include various home electronic appliances having network functions, such as an Internet refrigerator, a digital TV or a set-top box, which is capable of being connected to an external communication network such as s high-speed communication network in home, as well as a typical telephone and computer as various multimedia services are provided.

In addition, for example, the electronic appliance 100 may include at least one lighting apparatus controlled by a dimming device (not shown).

As another example, the electronic appliance 100 may include at least one sensing module disposed in home. The sensing module may include at least one of a thermal sensor, a smoke sensor, a temperature sensor and an illumination sensor.

The wireless control apparatus 300 may include an input unit for inputting a user instruction. The wireless control apparatus 300 may transmit a control signal corresponding to the input user instruction through a wireless network by a communication module 400 to an outside.

The wireless control apparatus 300 may include a remote controller, a dimmer, a wall pad or a smart phone.

The wireless network scheme used in the communication module 400 of the wireless control apparatus 300 may be determined according to a wireless environment.

A ZigBee, Bluetooth or Z-wave network scheme may be applied as the wireless network scheme.

The wireless control apparatus 300 may has a configuration shown in FIGS. 2 and 3.

Referring to FIG. 2, the wireless control apparatus 300 may include a control module 310 and a communication module 400.

The communication module 400 is detachably attached to a control module 310, receives a control signal corresponding to a user instruction and transmits the control signal to the communication module 400 of the electronic appliance 100 through a specific wireless network.

Referring to FIG. 3, as shown in FIG. 2, the wireless control apparatus 300 includes a control module 310 and the communication module 400. The control module 310 includes a mode switching unit 301, a memory unit 303, a power source/charging unit 305 and a control unit 307.

For example, the mode switching unit 301 may perform an operation mode switching, for example, a switching into a mode for controlling the electronic appliance 100 while a general function of a remote controller is performed.

The memory unit 303 may store an operation and communication control program/protocol therein.

The power source/charging unit 305 is charged and provides electric power for an operation of the wireless control apparatus 300.

The communication module 400 transmits the control signal corresponding to the user instruction provided from the control unit 307 to the electronic appliance 100 through a wireless network in a preset scheme.

The control unit 307 controls operations of the mode switching unit 301 and the power source/charging unit 305 by using data stored in the memory unit 303.

The electronic appliance 100 has a configuration as shown in FIG. 4.

The electronic appliance 100 includes a main module 500 for performing a main function and a communication module 400 for transmitting a control signal in communication with the wireless control apparatus 300.

As shown in FIG. 4, the communication module 400 of the electronic appliance 100 is inserted into an inserting hole 511 formed in the main module 500 and is detachably fixed to the main module 500.

The electronic appliance 100 receives a plurality of pins of an interface unit 450 of the communication module 400 and has the inserting hole 511 to fix the pins of the interface unit 450 inserted therein.

The inserting hole 511 may protrude from a surface of the main module 500 and may be coupled at an inside thereof to a connector (not shown) connected to a power source control unit (not shown) of the main module 500.

As describe above, the communication module 400 of the electronic appliance 100 is detachably coupled to the main module 500 so that the communication module 40 may be reused when a component such as a power control unit in the main module 500 is exchanged.

In such a network system, since both of the control apparatus 300 and the electronic appliance include the detachable communication modules 400, a communication module 400 selected according to a specific communication scheme may be installed, so that a network system for transceiving a control signal in a new communication scheme may be constructed.

As described above, in one network system, the communication module 400 installed in the control apparatus 300 or the electronic appliance 100 is exchanged for a new one so that a new network system may be constructed. Thus, it is possible to construct a system suitable for a network environment.

In this case, the communication modules 400 installed in the control apparatus 300 and the electronic appliance 100 may have the same configuration, the communication module 400 may have a configuration as shown in FIG. 5.

The communication module 400 is configured in one housing, constitutes one unit, and includes an antenna unit 410, a wireless communication unit 430 and an interface unit 450.

The antenna unit 410 receives a control signal transmitted from the control apparatus 300 through a wireless network.

The wireless communication unit 430 receives the control signal from the antenna unit 410 and generates a plurality of output signals to transmit the output signals to the main module 500 according to the control signal.

The wireless communication unit 430 includes a communication integrated circuit (not shown) for analyzing the control signal received through the antenna unit 410 according to a kind of the wireless network.

That is, the communication module 400 may include a communication integrated circuit corresponding to a predetermined wireless network environment.

The communication integrated circuit 435 may support at least one of ZigBee, Z-wave and Bluetooth communication schemes.

The interface unit 450 includes a plurality of pins corresponding to the output signals output from the wireless communication unit 430.

As shown in FIG. 5, the number of pins may be five, but the embodiment is not limited thereto.

The main module 500 may an interface unit (not shown), a control unit (not shown) and an output unit (not shown).

The interface unit of the main module 500 includes an inserting groove 511 which is connected to the interface unit 450 of the communication module 400 to receive an output signal transmitted through the communication module 400.

The control unit of the main module 500 includes a power supply apparatus, receives the output signal transmitted from the interface unit of the main module 500, and provides a signal for executing a corresponding function (for example, a lighting signal when the electronic appliance is a lighting appliance) to the output unit of the main module 500.

Hereinafter, a configuration of the communication module detachably installed into the main module 500 of the electronic appliance 100 and the control apparatus 300 will be described with reference to FIGS. 6 to 11.

Figure 6:
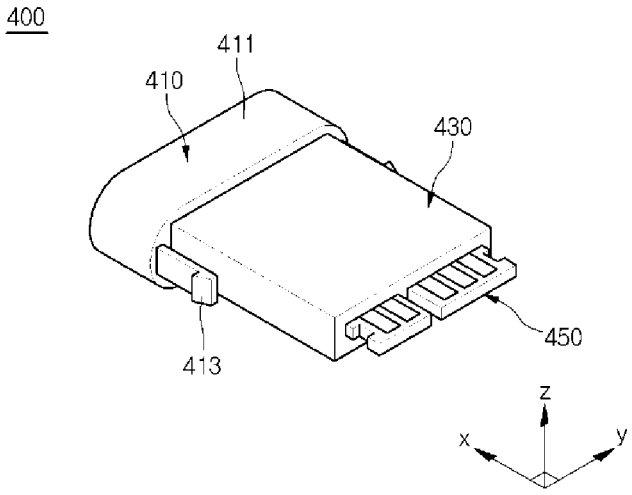
FIG. 6 is a perspective view showing the communication module of FIG. 1.
Figure 7A:
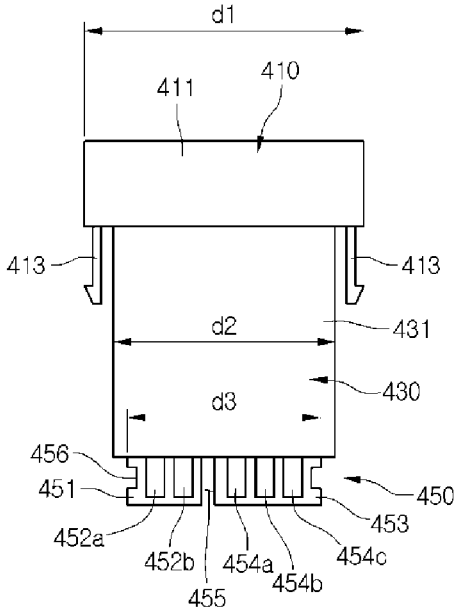
FIGS. 7*a* and 7*b* are a top view and a side view showing the communication module of FIG. 6.
Figure 7B:
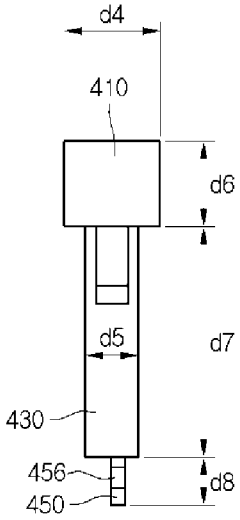
Figure 8:
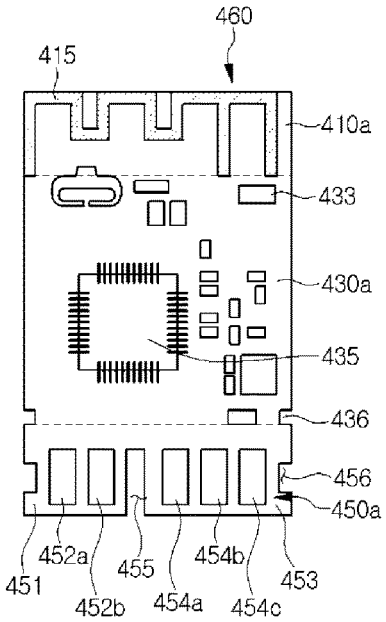
FIG. 8 is a top view showing a printed circuit board in the communication module of FIG. 6.
Figure 9:
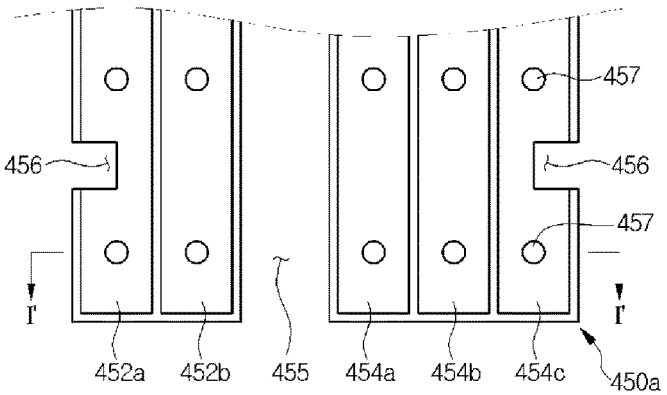
FIG. 9 is an enlarged view showing an interface unit of the printed circuit board of FIG. 8.
Figure 10:
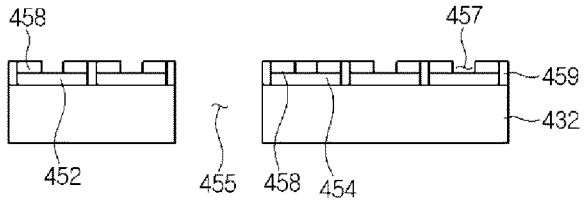
FIG. 10 is a sectional view taken along line I-I' of an interface unit of FIG. 9 according to an embodiment.
Figure 11:
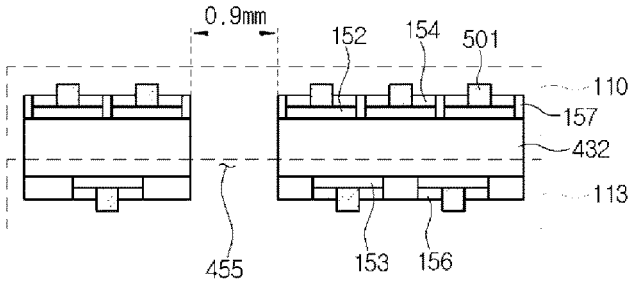
FIG. 11 is a sectional view taken along line I-I' of an interface unit of FIG. 9 according to another embodiment.

FIG. 6 is a perspective view showing the communication module of FIG. 1. FIGS. 7*a* and 7*b* are a top view and a side view showing the communication module of FIG. 6. FIG. 8 is a top view showing a printed circuit board in the communication module of FIG. 6. FIG. 9 is an enlarged view showing an interface unit of the printed circuit board of FIG. 8. FIG. 10 is a sectional view taken along line I-I' of an interface unit of FIG. 9 according to an embodiment. FIG. 11 is a sectional view taken along line I-I' of an interface unit of FIG. 9 according to another embodiment.

Referring to FIGS. 6 to 10, the communication module 400 according to the embodiment includes a printed circuit board in which the antenna unit 410, the wireless communication unit 430 and the interface unit 450 are integrated and a housing 411 and 431 receiving a portion of the printed circuit board.

As shown in FIG. 6, the housing 411 and 431 receives the printed circuited board while exposing a region corresponding to the interface unit 450 to an outside. In this case, the region corresponding to the interface unit 450 protrudes out of the housing 411 and 431.

The housing 411 and 431 includes a first receiving part 411 for receiving the antenna unit 410 and a second receiving part 431 protruding from the first receiving part 411 in a first direction (x) for receiving the wireless communication unit 430.

The first and second receiving parts 411 and 431 may be formed in a single body. The first and second receiving parts 411 and 431 may be a coupled body resulting from coupling an upper body and a lower body to each other in a second direction (z) perpendicular to the first direction (x).

The housing 411 and 431 may be formed of an insulating material. Preferably, the housing 411 and 431 may be formed of a rigid type plastic material such as polyamide.

The first receiving part 411 has a space for receiving the antenna unit 410 of the printed circuit board therein and an elongate rectangular shape extending in a third direction (y).

The first receiving part 411 may have a first width d1 in the range of 20 mm to 25 mm or preferably, of 22 mm in the third direction (y), and a width d6 in the range of 6 mm to 7 mm or preferably, 6.4 mm to 6.5 mm in the first direction (x). In addition, the first receiving part 411 may have a height d4 in the range of 7 mm to 8 mm or preferably, of 7.7 mm in the second direction (z).

A side of the first receiving part 411 may be chamfered to have a curvature.

The printed circuit board inserted into the space of the first receiving part 411 includes an antenna region corresponding to the antenna unit 410.

As shown in FIG. 8, the antenna region 410*a* is formed in one end of the printed circuit board and includes an antenna pattern 415 patterned on a support substrate 432.

The antenna pattern 415 may have a planar inverted F antenna (PIFA), but the embodiment is not limited thereto.

That is, the antenna pattern 415 may be a pattern antenna such as a monopole antenna or a dipole antenna. In addition, the antenna pattern 415 may be implemented by mounting a chip antenna.

When the support substrate 432 serves as an antenna dielectric body, the antenna region 410*a* may include the antenna pattern 415 on the support substrate 431, a ground layer (not shown) below the support substrate 432, and a matching pattern (not shown) at an inside or outside of the dielectric body.

The antenna unit 410 is provided to transmit and/or receive a signal in a predetermined frequency band. That is, the antenna pattern 415 resonates in a predetermined frequency band so that a signal (receiving signal or transmitting signal) may pass therethrough. The antenna pattern 415 resonates at predetermined reference impedance.

The antenna pattern 415 is adjacent to the ground layer such that a feeding point is positioned at one end thereof. In this case, the feeding point may pass through the substrate 432 which serves as the dielectric body and extend to a lower surface of the substrate 432. Thus, the antenna pattern 415 may include at least one horizontal component circuit and a vertical component circuit which are distinguished from each other based on a bending portion.

For example, the antenna pattern 415 may be formed with a transmission circuit having at least one of a meander type, a spiral type, a step type and a loop type The ground layer is provided to ground the antenna pattern 415.

The internal or external matching pattern is provided to match the impedance of the antenna pattern 415 to reference impedance.

Since the antenna unit 410 is formed in a plate shape, the antenna unit 410 is enabled to be integrated into a small size communication module 400.

The antenna pattern 415 may be formed of a material including metal such as a conductive material, copper, aluminum, nickel or molybdenum.

Meanwhile, the second receiving part 431 protruding from the first receiving part 411 in the first direction (x) may have a width d2 in the range of 17 mm to 18 mm or preferably, 17.4 mm to 17.5 mm in the third direction (y), and a width d7 in the range of 18 mm to 19 mm or preferably, 18 mm to 18.2 mm in the first direction (x). In addition, the second receiving part 431 may have a height d5 in the range of 4.5 mm to 5.2 mm or preferably, of 5 mm.

As describe above, the width d2 of the second receiving part 431 in the third direction (y) is narrower than that of the first receiving part 411, so that a dummy space is formed in a side surface of the first receiving part 411. Since the second receiving part 431 has a height d5 lower than the first receiving part 411, step difference may be formed between the first and second receiving parts 411 and 431.

The second receiving part 431 has a pillar-shaped space for receiving the wireless communication unit 430 of the printed circuit board therein.

As shown in FIG. 6, the second receiving part 431 may have a rectangular parallelepiped shape.

A fixing part 413 is formed in the space formed in a side surface of the first receiving part 411.

As shown in FIG. 6, the fixing part 413 is formed in the dummy space formed by the area difference between the first and second receiving parts 411 and 413, and protrudes from the side surface of the first receiving part 411 in the first direction (x).

Since the fixing part 413 is formed integrally with a body of the housing 411 and 431 such that the fixing part 413 has a protrusion having a triangular shape, the fixing part 413 provides a latching function of coupling the main module 500 or the control apparatus 300 thereto, so that the fixing strength may be improved.

The fixing parts 413 may be formed on both side surfaces of the second receiving part 431, respectively, and may be opposite to each other such that the triangular shaped protrusions are orientated toward an outside.

Meanwhile, as shown in FIG. 8, a plurality of devices is mounted on a module region 430*a* which corresponds to the wireless communication unit 430 inserted in the space of the second receiving part 431.

The wireless integrated circuit 435 for the purpose of communicating with the control apparatus 300 is mounted on the module region 430*a*.

As the wireless integrated circuit 435, one selected from ZigBee, Wi-Fi, Z-wave and Bluetooth integrated circuits 435 may be mounted. In this case, peripheral passive elements and circuit configurations may be modified according to a kind of the wireless integrated circuit 435.

A connecting pad 433 for the purpose of connecting with an external antenna may be formed in a boundary region between the module 430*a* and the antenna region 410*a*.

A recess 436 for fixing the housing 411 and 431 and the printed circuit board is formed in the boundary region between the module 430*a* and a terminal region 450*a*. The recess 436 is coupled to a protrusion formed on an inner surface of the housing 411 and 431.

Meanwhile, the terminal region 450*a* of the printed circuit board corresponding to the interface unit 450 protruding from the end of the second receiving part 431 of the housing 411 and 431 includes a plurality of pins 452*a*, 452*b*, 454*a*, 454*b* and 454*c*, as shown in FIG. 6.

The width of the terminal region 450*a* from the end of the housing 411 and 431 in the first direction (x) may have a length d8 in the range of 3.5 mm to 4.0 mm and the width d3 in the third direction (y) may have the length of 15 mm.

The terminal region 450*a* includes the pins 452*a*, 452*b*, 454*a*, 454*b* and 454*c* on the support substrate 432. The number of pins 452*a*, 452*b*, 454*a*, 454*b* and 454*c* may be five, but the embodiment is not limited.

As describe above, when there exist the plurality of pins 452*a*, 452*b*, 454*a*, 454*b* and 454*c*, the pins 452*a*, 452*b*, 454*a*, 454*b* and 454*c* are grouped in a predetermined number and the terminal area 45*a* may include the recess 455 in which the support substrate 432 between the grouped pins 452*a*, 452*b*, 454*a*, 454*b* and 454*c* is removed.

The pins 452*a* and 452*b* grouped at the left side about the recess 455 is defined as a first pin part 451 and the pins 454*a*, 454*b* and 454*c* grouped at the right side about the recess 455 is defined as a second pin part 453. OK The numbers of pins of the first pin part 451 may be different from that of the second pin part 453.

When five pins are included in the terminal region 450*a*, the first pin part 451 may include two pins 452*a* and 452*b* and the second pin part 453 may include three pins 454*a*, 454*b* and 454*c*.

As described above, the pins 452*a*, 452*b*, 454*a*, 454*b* and 454*c* may be grouped with mutually different numbers, so that front and rear surfaces of the communication module 400 may be distinguished from each other.

In addition, the recess 455 is formed between the first and second pin parts 451 and 453, so that the interference between the pins 452*a*, 452*b*, 454*a*, 454*b* and 454*c* of the first and second pin parts 451 and 453 may be reduced.

The width of the recess 455 may be 0.9 mm or more, and the gap distance between the pins 452*a*, 452*b*, 454*a*, 454*b* and 454*c* may be set to be 0.8 mm or less, but the embodiment is not limited thereto.

Meanwhile, the first and second pin parts 451 and 453 distinguished from each other by the recess 455 are classified according to the functions of each pin.

In more detail, the recess 455 divides the pins 452*a*, 452*b*, 454*a*, 454*b* and 454*c* into the first and second pint parts 451 and 453 according to a kind of signal transmitted through the pins 452*a*, 452*b*, 454*a*, 454*b* and 454*c*.

That is, the first and second pins 451 and 453 may be classified into the pins for performing the function of transmitting a control signal and the pins for performing other functions.

Further, in the embodiment, when five pins 452*a*, 452*b*, 454*a*, 454*b* and 454*c* are formed, the central pin among the pins 452*a*, 452*b*, 454*a*, 454*b* and 454*c* may serve as a ground pin, so that interference between the first and second pin parts 451 and 453 may be additionally reduced.

In this case, the pin for performing the ground function may be included in the first pin part 451. To the contrary, the pin for performing the ground function may be included in the second pin part 453.

Preferably, since the second pin part 453 does not include a pin for performing the function of transmitting the control signal, the pin for performing the ground function is included in the second pin part 453.

As described above, the pins 452*a*, 452*b*, 454*a*, 454*b* and 454*c* are divided by the recess 455 according to each function, so that mutual interference between the pins 452*a*, 452*b*, 454*a*, 454*b* and 454*c* may be reduced.

In addition, a ground pin is positioned at the center of the pins 452*a*, 452*b*, 454*a*, 454*b* and 454*c*, so that the ground pin may additionally reduce the mutual interference together with the recess 455.

A protrusion (not shown) may protrude from the support substrate 432 on the boundary between the first and second pin parts 451 and 453.

Meanwhile, the terminal region 450*a* includes latching recesses 456 recessed inwardly from both sides of the terminal region 450*a*.

As shown in FIG. 8, the latching recess 456 may be formed in the dummy region of an edge in which the pins 452*a*, 452*b*, 454*a*, 454*b* and 454*c* are not formed, as shown in FIG. 8. Differently from the above, as shown in FIG. 9, the latching recess 456 may be formed by removing a portion of the pin 452*a*, 452*b*, 454*a*, 454*b* or 454*c* disposed on the edge.

When the terminal region 450*a* is inserted into the connector 511 of the main module 500, the latching recess 456 is coupled to the protrusion (not shown) in the connector 511, so that the coupling strength may be improved.

As shown FIG. 9, the terminal region 450*a* may include at least one concave portion 457 in an edge region of each pin 452*a*, 452*b*, 454*a*, 454*b* or 454*c* in the first direction (x).

In detail, as shown in FIG. 10, the printed circuit board includes the plurality of pins 452*a*, 452*b*, 454*a*, 454*b* and 454*c* formed by patterning the electrode layer on the support substrate 432.

The support substrate 432 may be formed in an insulating layer having a rigid or flexible property. Preferably, support substrate 432 may be formed of resin such as epoxy resin or polyimide resin.

The electrode layer including the pins 452*a*, 452*b*, 454*a*, 454*b* and 454*c* on the support substrate 432 may be formed of an alloy including copper, aluminum, molybdenum or tungsten as a conductive material.

Preferably, the electrode layer may be formed by patterning a copper thin layer.

In addition, according to the embodiment, a plurality of circuit patterns is formed by patterning the electrode layer. In case of a region operated as a pad such as the pins 452*a*, 452*b*, 454*a*, 454*b* and 454*c* of the terminal region 450*a* in the circuit patterns, as shown in FIG. 10, an exposed region is plated.

The plating may protect the plated region from physical and chemical impact and may improve the conductivity of the plated region.

The plating layer 458 may be formed by using metal such as nickel, gold, silver or palladium. Preferably, the playing layer 458 may be formed by plating the copper thin layer with nickel and gold.

The concave portion 457 may be formed by removing at least the plating layer 458 such that the pins 452*a*, 452*b*, 454*a*, 454*b* and 454*c* below the plating layer 458 are exposed. As described above, the concave portion 457 is formed in the edge region of the pins 452*a*, 452*b*, 454*a*, 454*b* and 454*c*, so that the plating layer 458 and the electrode layer may be firmly fixed to each other.

In this case, according to the embodiment, the concave portion 457 may be formed by removing even the electrode layer, so that the support substrate 432 may be exposed. Further, the concave portion 457 may be formed as a via-hole by removing even the support substrate 432.

The concave portion 457 is formed on an edge region in the area of the pins 452*a*, 452*b*, 454*a*, 454*b* and 454*c* except for a central region with which the pins of the connector 511 of the main module 500 make contact, so that the fixing strength of the plating layer 458 is increased while the planarization of the pins 452*a*, 452*b*, 454*a*, 454*b* and 454*c* is maintained, thereby improving the reliability.

The printed circuit substrate further includes a solder resist 459 covering the region on the support substrate 432 except for the pad including the pins.

Meanwhile, the antenna unit 410, the wireless communication unit 430 and the interface unit 450 are provided in the housing 411 and 431. The antenna unit 410 and the interface unit 450 are disposed at both sides opposite to each other, respectively while the wireless communication unit 430 is interposed between the antenna unit 410 and the interface unit 450 in the housing 411 and 431.

Thus, the interface unit 450 is easily inserted into the electronic appliance 100 or the wireless control apparatus 300, so that a wireless communication function is provided to the electronic appliance 100 or the wireless control apparatus 300.

In addition, as described above the antenna unit 410 is disposed at the farthest place away from the interface unit 450.

Thus, the antenna unit 410 is not affected by the communication performed through the interface unit 450 between the communication module 400 and a connection object (electronic appliance 100) or the wireless control apparatus 300, so that the antenna 410 may effectively receive a signal transmitted from an outside.

Meanwhile, the terminal region 450*a* may have the configuration shown in FIG. 11.

The terminal region 450*a* of FIG. 11 may include an upper pin 152 on the support substrate 432 and a lower pin 153 below the support substrate 432.

When the pins 152 and 153 are formed on upper and lower portion of the support substrate 432, the laminated structures, which are equal to each other and each of which includes an electrode layer, a plating layer 154 and 156 and a solder resist 157, are formed on both surfaces of the support substrate 432.

In this case, the upper and lower pins 152 and 153 are disposed in a zigzag shape as shown in FIG. 11.

That is, the upper and lower pins 152 and 153 are disposed to allow the center of the lower pin 153 to correspond to the spaced region between the neighbored upper pins, so that the top and bottom surfaces of the communication module 400 may be distinguished from each other.

In addition, the pressure caused when the upper and lower pins 152 and 153 make contact with the pins 501 of the connector of the main module 500 may be dispersed.

As described above, plural functional elements of the communication module 400 may be implemented in a single printed circuit board, and the electrode layer on the support substrate 432 of the printed circuit board is patterned so that the antenna pattern 415, the pins 452 and 454 and the inner circuit pattern of the module region 430*a* may be simultaneously formed.

The printed circuit board constituting one communication module 400 may be formed to have a circuit pattern which is changed according to a kind of the wireless integrated circuit 435 and a light control scheme of a lighting unit 530.

Thus, when a plurality of printed circuit boards are formed according to the kind of the wireless integrated circuit 435 and the light control scheme, a specific printed circuit board is selectively coupled to the housing 411 and 431 of the communication module 400, so that the communication module 400 may be implemented.

Hereinafter, when the electronic appliance 100 is a lighting apparatus, the configuration of the interface unit 450 and the circuit configuration in the module region 430*a* according to the light control scheme will be described.

Figure 12:
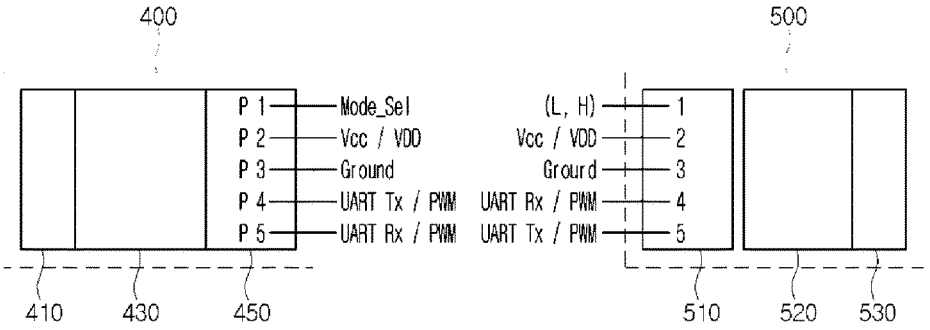
FIG. 12 is a view showing a corresponding relationship of the interface units of the electronic appliance of FIG. 1.
Figure 13:
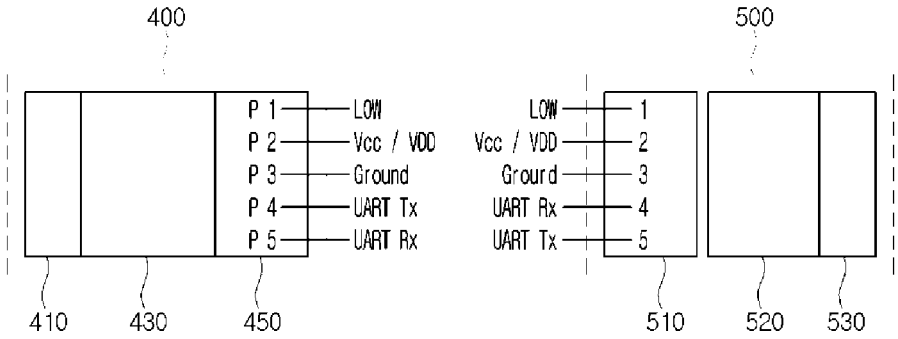
FIG. 13 is a view showing the corresponding relationship of FIG. 12 according to an embodiment.
Figure 14:
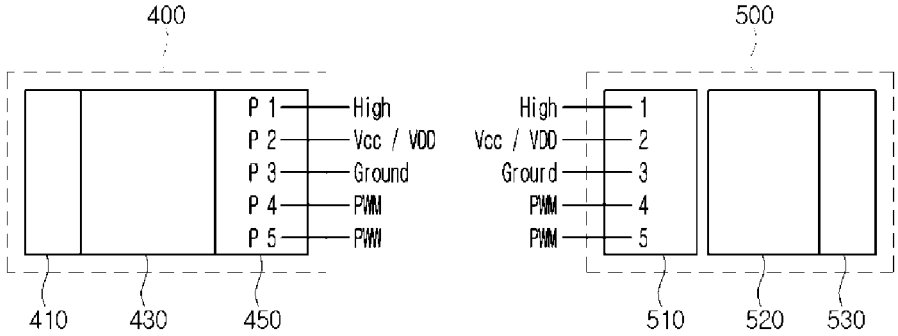
FIG. 14 is a view showing the corresponding relationship of FIG. 12 according to another embodiment.
Figure 15:
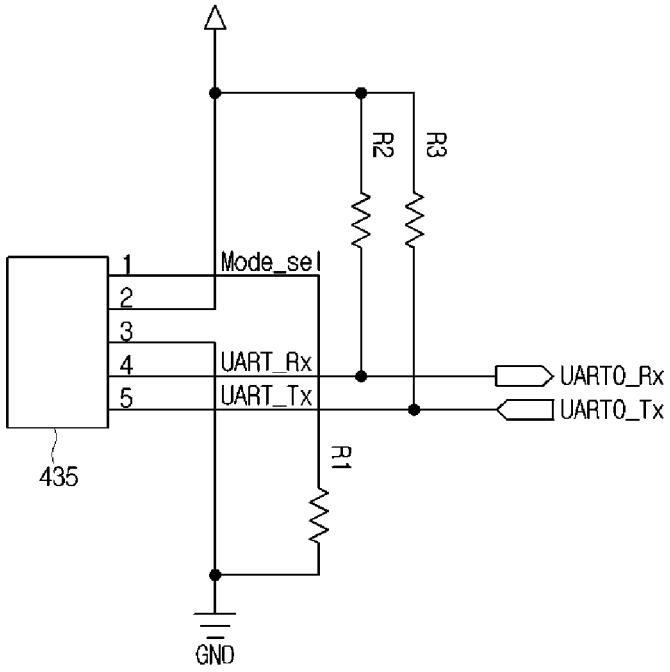
FIG. 15 is a circuit diagram of a communication module satisfying the corresponding relationship of FIG. 13.
Figure 16:
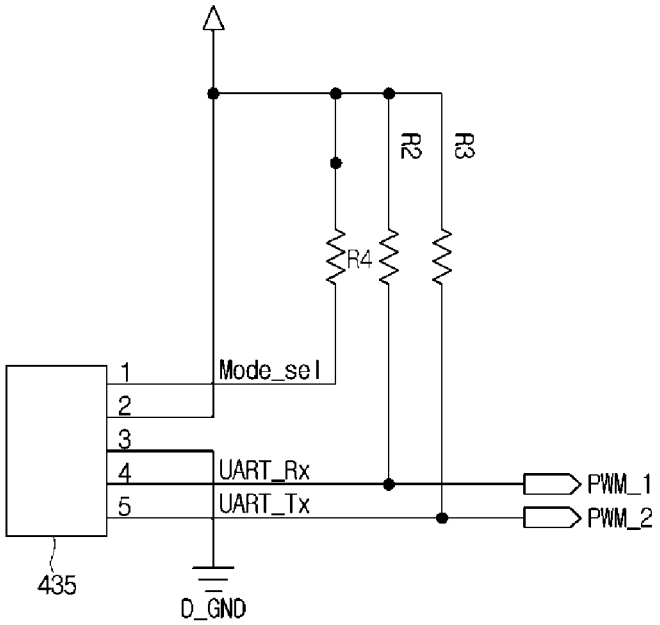
FIG. 16 is a circuit diagram of a communication module satisfying the corresponding relationship of FIG. 14.
Figure 17:
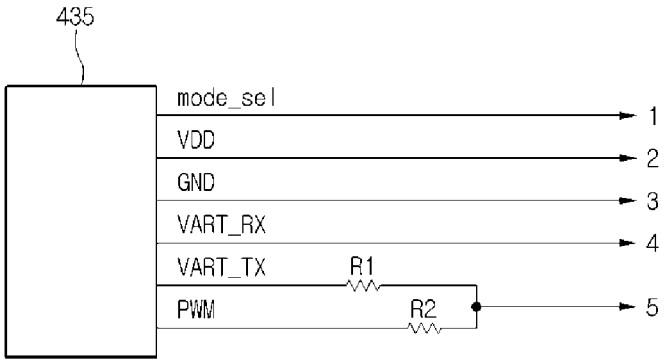
FIG. 17 is a circuit diagram showing a connection between the interface unit of the communication module and the wireless integrated circuit of FIG. 6.

FIG. 12 is a view showing a corresponding relationship between the interface units 450 of the electronic appliance 100 of FIG. 1. FIG. 13 is a view showing the corresponding relationship of FIG. 12 according to an embodiment. FIG. 14 is a view showing the corresponding relationship of FIG. 12 according to another embodiment. FIG. 15 is a circuit diagram of a communication module 400 satisfying the corresponding relationship of FIG. 13. FIG. 16 is a circuit diagram of a communication module 400 satisfying the corresponding relationship of FIG. 14. FIG. 17 is a circuit diagram showing a connection between the interface unit of the communication module of FIG. 6 and the wireless integrated circuit.

Hereinafter, reference numerals P1 to P 5 denote each pin.

Referring to FIG. 12, when the interface unit 450 of the communication module 400 constituting the electronic appliance 100 includes five pins P1 to P5, as shown in FIG. 12, output signals are set to the interface pins P1 to P5 of the communication module 400 and the connector pins of the interface units 510 of the main module 500.

That is, a mode control signal mode_se1 for selecting a mode according to a light control scheme is output through the first pin P1, a reference voltage Vcc/Vdd for driving the communication module 400 is received through the second pin P2, a ground voltage Ground is received through the third pin P3, a light control signal is transmitted or received through the fourth and fifth pins P4 and P5 by which a kind of the light control signal may be changed.

That is, the first to third pins P1 to P3 are concerned with a reference voltage and the fourth and fifth pins P4 and P5 are concerned with a control signal. The recess 455 may be formed between the third and fourth pins P3 and P4.

A UART or PWM scheme may be applied as the light control scheme. The mode control signal mode_se1 is set as a logic high or low.

If describing the UART scheme with reference to FIGS. 13 and 15, the UART scheme uses two pins, one of which is used for receiving a signal and the other is used for transmitting a signal.

The UART scheme is applied to a flat panel light or a light which is required to perform relatively many controls. For example, the UART scheme may serve as a control scheme used to control an LED lighting device (color temperature, bright or dimming), but the embodiment is not limited thereto and may be modified according to a setting manner.

In this case, the main module 500 generally includes an additional control unit (MCU), but the communication module of the UART scheme is applied as described above, such that the main module 500 may be directly controlled without the control by the control unit of the main module 500.

As described above, when the main module 500 is controlled in the UART scheme, the mode selecting signal mode_se1 is set as a logic low, the fourth pin P4 is set for transmission and the fifth pin P5 is set for reception.

To this end, the printed circuit board includes a circuit shown in FIG. 15.

That is, the circuit is formed between five terminals of the wireless integrated circuit 435 and five pins P1 to P5 of the terminal region 450*a*, in which, when the reference voltage and the ground voltage are applied, the reference voltage is applied to the fourth and fifth pins P4 and P5 through each resistor (pull-up resistors) R2 and R3.

In this case, the first pin P1 through which the mode selecting signal is output is connected to the ground through the first resistor (pull-down resistor) R1, so that the mode selecting signal mode_se1 is set to have a low level value.

Meanwhile, if describing the PWM scheme with reference to FIGS. 14 and 16, the PWM scheme is used for simply controlling brightness as in a light emitting diode, but the embodiment is not limited thereto. The main module 500 may control a light brightness by a duty ratio of a pulse width.

In this case, the light brightness may include all of color temperature, brightness and dimming controls.

As describe above, when the main module 500 is controlled in the PWM scheme, the mode selecting signal mode_se1 is set as a logic high, warm color temperature is controlled through the fourth pin P4 during a dimming operation and cool color temperature is controlled through the fourth and fifth pins P4 and P5 during the dimming operation. Thus, when the color temperature is controlled, control signals are simultaneously output through the fourth and fifth pins P4 and P5.

To this end, the printed circuit board includes a circuit shown in FIG. 16.

That is, the circuit is formed between five terminals of the wireless integrated circuit 435 and five pins P1 to P5 of the terminal region 450*a*, in which, when the reference voltage and the ground voltage are applied, the reference voltage is applied to the fourth and fifth pins P4 and P5 through each resistor (pull-up resistors) R2 and R3.

In this case, the reference voltage is applied to the first pin P1 through which the mode selecting signal mode_se1 is output through the fourth resistor (pull-up resistor) R4, so that the mode selecting signal mode_se1 is set to have a high level value.

Meanwhile, in the embodiment, when a control signal is transmitted through a Z-wave network, the wireless integrated circuit generates a total of six output signals according to the light control scheme.

That is, a mode control signal mode_se1, a reference voltage Vcc/Vdd, a ground voltage Ground, and UART_RX, UART_TX and PWM signals are output through mutually different output terminals.

In another communication scheme, the UART_RX, UART_TX and PWM signals are selectively output through two output terminals according to a mode selection, so that five output terminals are connected to five pins of the interface unit. However, when the Z-wave network is applied, the UART_RX, UART_TX and PWM signals are output through mutually different output terminals of the wireless integrated circuit having six output terminals.

Thus, when a control signal is transmitted to the main module by using five pins of the interface unit, a circuit shown in FIG. 17 may be implemented.

Referring to FIG. 17, the UART_RX signal is output through one of the output terminals of the wireless integrated circuit and is transmitted through one pin of the interface unit.

In addition, the UART_TX and PWM signals are output through two of the output terminals of the wireless integrate circuit, respectively.

In this case, the output terminals outputting the UART_TX and PWM signals are connected to terminals of the first and second resistors, respectively and the other terminals of the first and second resistors are commonly connected to one pin of the interface unit.

In this case, when an output signal is output through one output terminal of the first and second resistors, in order to prevent a reflected signal from being input through another output terminal, the first and second resistors have high resistance values.

Thus, when an output signal is output through one of two terminals, the other terminal is connected to the first or second resistor. Since the pins of the interface unit have no resistance component, the pins induce the output signal to be output through the pins of the interface unit. The first and second resistors may have a resistance value of at least 50Ω.

Although it is described in the embodiment to control a light by using five pins P1 to P5, the light may be controlled by using a plurality of pins. When the light is controlled by using the plurality of pins, even though the Z-wave network is applied, signals may be transmitted through each pin, so that the circuit shown in FIG. 17 may be omitted.

Hereinafter, various application examples of the embodiment will be described with reference to FIGS. 18 to 23.

Figure 18:
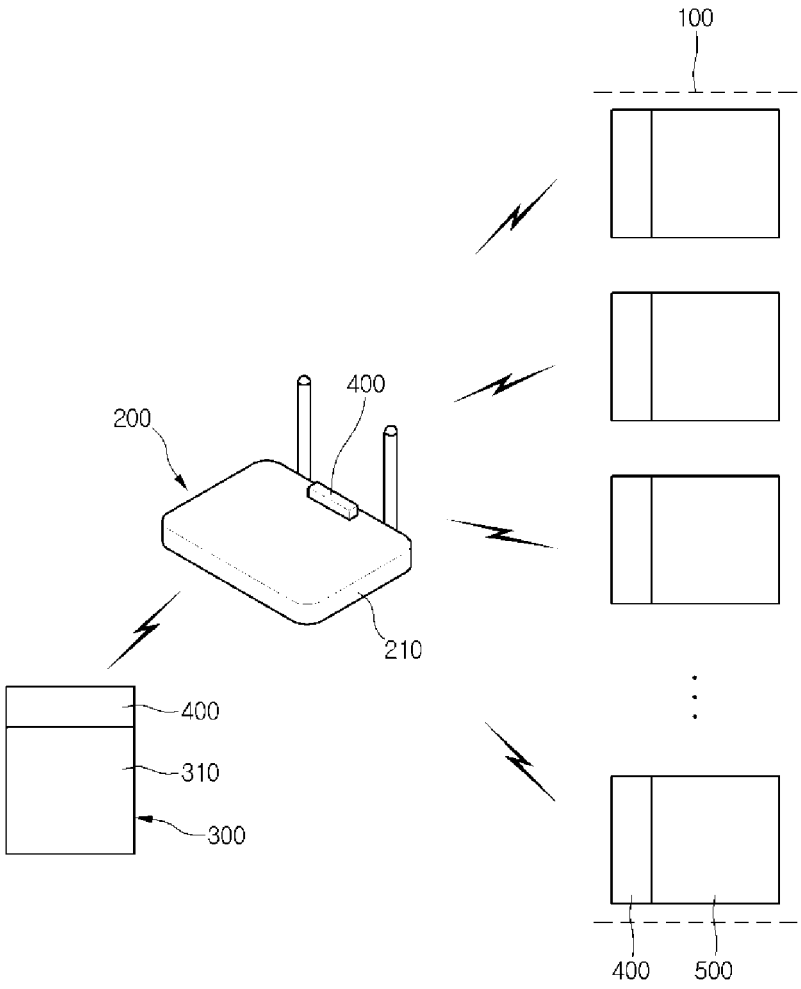
FIG. 18 is a view showing a network system according to the second embodiment.
Figure 19:
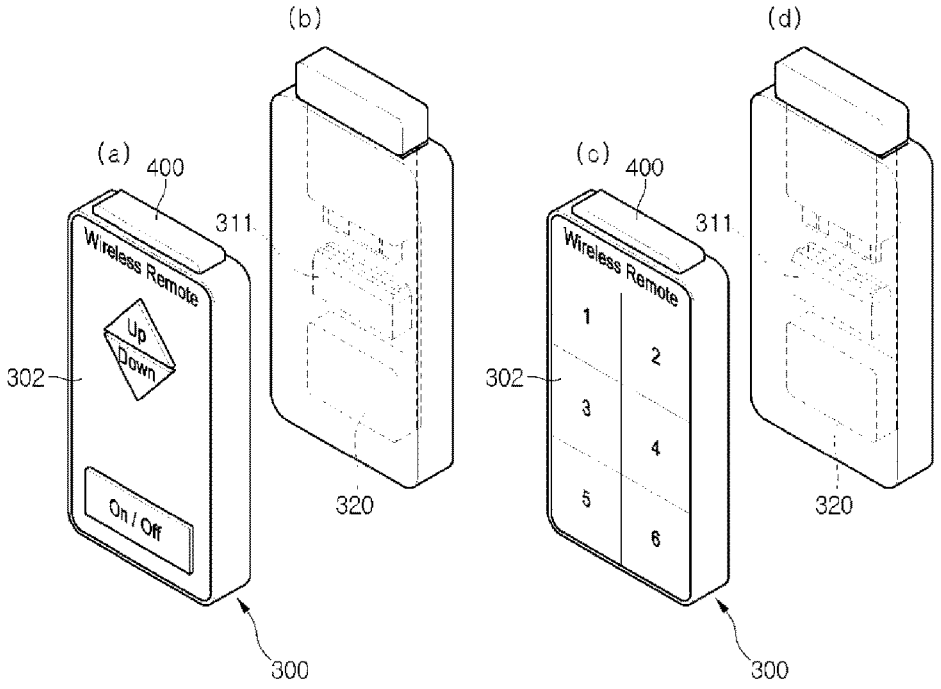
FIGS. 19 to 21 are perspective views showing various application examples of the control apparatus of FIG. 18.
Figure 20:
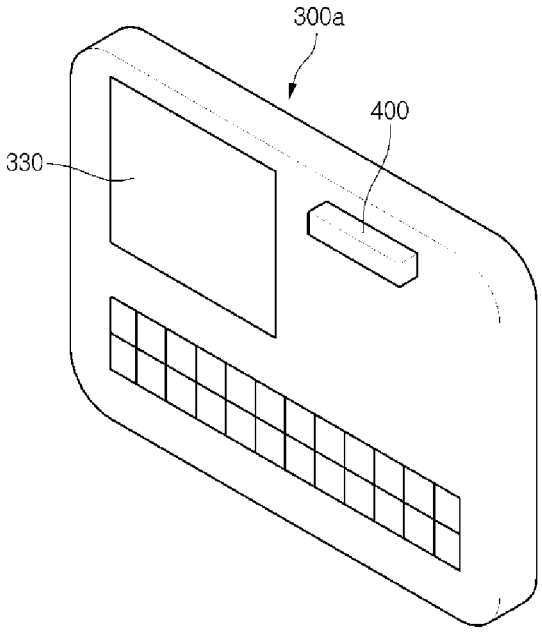
Figure 21:
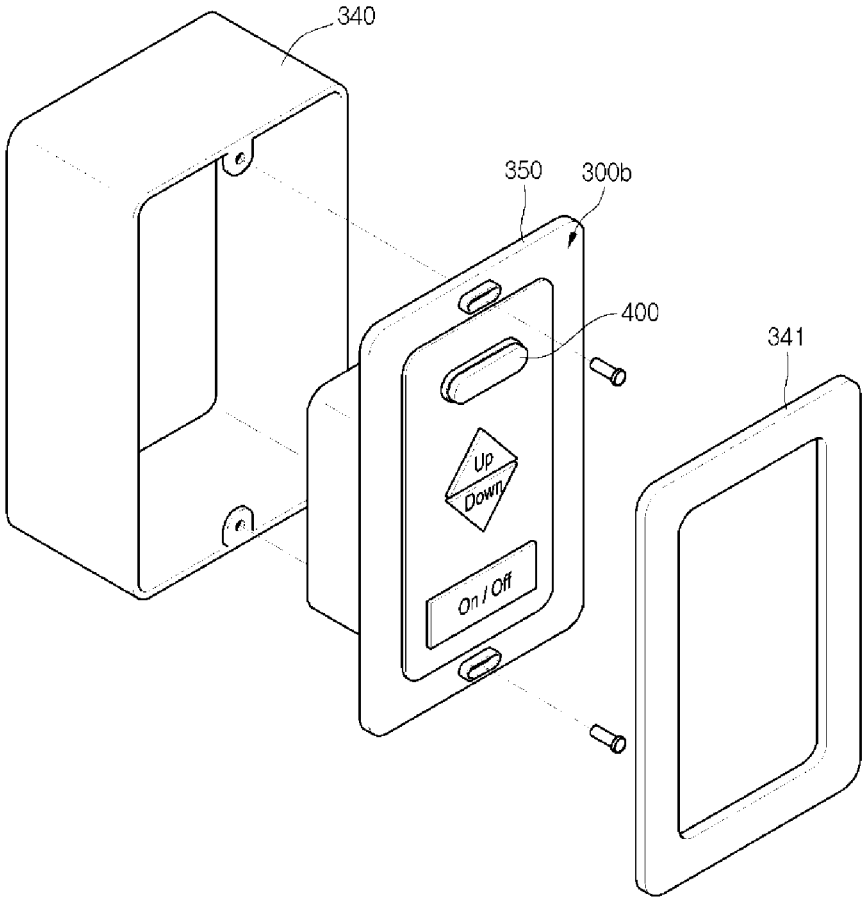
Figure 22:
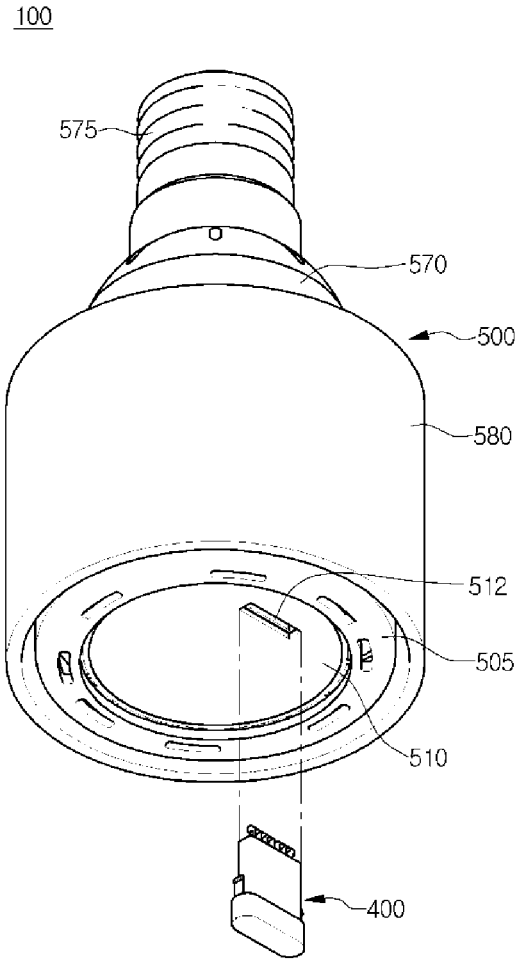
FIGS. 22 and 23 are perspective views showing various application examples of the electronic appliance of FIG. 18.
Figure 23:
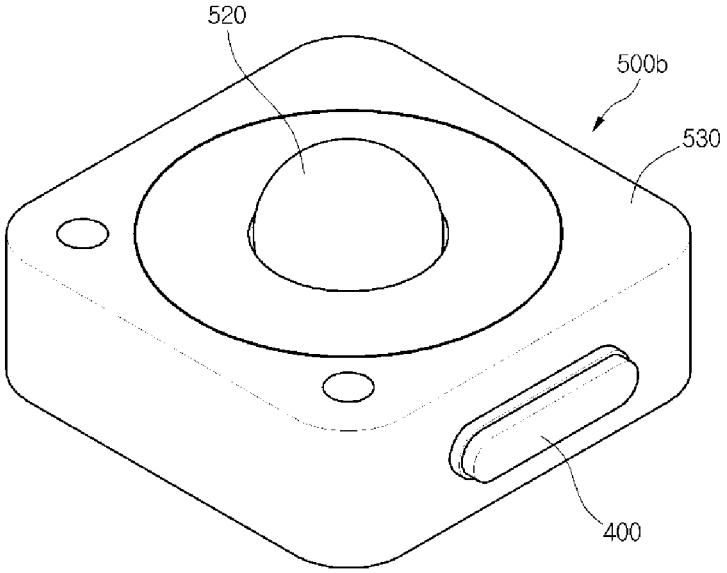

FIG. 18 is a view showing a network system according to the second embodiment. FIGS. 19 to 21 are perspective views showing various application examples of the control apparatus of FIG. 18. FIGS. 22 and 23 are perspective views showing various application examples of the electronic appliance of FIG. 18.

Referring to FIG. 18, a network system according to the second embodiment includes a wireless control apparatus 300, a gateway 200 and an electronic appliance 100.

The wireless control apparatus 300 is connected to the gateway 200 through a first communication network and the gateway 200 is connected to a plurality of electronic appliances 100 through a second communication network.

The electronic appliance 100 may include at least one electronic appliance, and at least four electronic appliances 100 are shown in the embodiment.

In this case, the electronic appliance 100 may include various home electronic appliances having network functions, such as an Internet refrigerator, a digital TV or a set-top box, which is capable of being connected to an external communication network such as s high-speed communication network in home, as well as a typical telephone and computer as various multimedia services are provided.

In addition, the electronic appliance 100 may include at least one lighting apparatus controlled by a dimmer.

Further, the electronic appliance 100 may include at least one sensor module disposed in home.

The wireless control apparatus 300, which may include an input unit for inputting a user instruction, may transmit a control signal according to a user instruction through the first communication network by the communication module 400.

The wireless control apparatus 300 may include a remote controller, a dimmer, a wall pad or a smart phone.

The gateway 200 performs a repeater function of transmitting the control signal from the wireless control apparatus 300 to a corresponding electronic appliance through the network.

The first communication network for communication with the wireless control apparatus 300 may be equal to or different from the second communication network for communication with the electronic appliance 100, and when the first and second communication networks are different from each other, the gateway 200 may include communication modules 400 for each network.

When the first and second communication networks are wireless networks, a ZigBee, Bluetooth or Z-wave scheme may be applied for the networks.

For the purpose of achieving the first and second communication networks, the gateway 200, as shown in FIG. 18, the gateway 200 may include a detachable communication module 400. The communication module 400 is inserted into a groove of the gateway body 210 to be fixed to the gateway body 210 such that the communication module 400 provides a communication network.

The wireless control apparatus 300 and the electronic appliance 100 may be equal to those of the first embodiment. In case of a system including the gateway 200, a network module formed in the gateway 200 provides a network different from that of the detachable communication module 400, such that electronic appliances 100 controlled through various networks may be controlled.

Meanwhile, the wireless control apparatus 300 according to the first or second embodiment may have a configuration shown in FIGS. 19 to 21.

FIGS. 9*a* to 9*d* show various application examples of a remote controller capable of controlling an electronic appliance.

The remote controller 300 of FIG. 19*a* includes an interface region 302 formed on a top surface thereof to receive a control from a user and a communication module 400 detachably attached to one side surface thereof.

The interface region 302 may include on/off and up/down buttons and may be applied for controlling a lighting appliance.

FIG. 19*b* is a view showing an inside of the remote controller 300. The remote controller 300 may include a connector 311 which a battery 320 and the interface unit 410 of the communication module 400 are inserted into and fixed to.

The battery 320 may be recharged when connected to a connector of a holder.

As shown in FIG. 19*c*, a button on which several numerals are denoted may be formed in the interface region 302 and, as shown in FIG. 19*d*, the interface region 302 may include the connector and the battery 320.

Meanwhile, referring to FIG. 20, the wireless control apparatus 300 may be a wall pad into which the communication module 400 is inserted.

The wall pad 300*a* may be fixed to a wall of home or an office. The wall pad 300*a* may include a communication module 400 inserted into a top surface thereof, a display region 330 and plural buttons.

In addition, referring to FIG. 21, the wireless control apparatus 300 may be a dimmer 300*b* into which the communication module is inserted.

The dimmer 300*b*, which controls on/off and up/down of brightness of a lighting apparatus, may include a receiving part 340 fixed to a wall of home or an office, a dimmer body 350 and a cover part 341.

The communication module 400 may be inserted into a surface of the dimmer body 350 and may be configured to allow only an antenna region to protrude to an outside.

Meanwhile, the electronic appliance 500 according to the first or second embodiment may have a configuration shown in FIG. 22 or 23.

The electronic appliance 100 may be a lighting apparatus 500*a* as shown in FIG. 22.

The lighting apparatus 500*a* includes an inner case 570 having a connecting terminal 575 at an upper portion of the inner case 570 and an inserting part at a low portion of the inner case 570, a heat radiation body (not shown) into which the inserting part of the inner case 570 is inserted, a light emitting module part including a plurality of light emitting devices which emit the light to the bottom surface of the heat radiation body, a guide member 505 coupled to a circumference region of a low portion of the heat radiation body to allow the light emitting module part to be primly fixed to the heat radiation body, a lens 510 formed between the guide member 505 and the light emitting module part, and an outer case 580 outside the heat radiation body.

The lens 510 includes a lens opening part 512 through which the communication module 400 is inserted. The communication module 400 is connected to the connector of the power control part through the lens opening part 512, such that the output signal by the control signal is transferred to the lighting apparatus 500*a* through the wireless network.

Meanwhile, as shown in FIG. 23, the electronic appliance 100 may be a sensor module 500*b*.

The sensor module 500*b* includes a module body 530 and at least one sensor 520 received in the module body 530.

The sensor 520 may include various sensors such as a temperature sensor, an illumination sensor and a motion sensor.

The communication module 400 may be detachably attached to the module body 400 such that a control signal may be provided to the sensor module 500*b*.

Although the light apparatus and the sensor module are described above as the electronic appliance 100, the embodiment is not limited thereto.

As described above, in one network system, the communication module 400 for the control apparatus 300, the electronic appliance 100 or the gateway 200 is selected and exchanged, so that, when a new network system is constructed, a system suitable for environment may be constructed.

Although exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A wireless control apparatus comprising:

a module unit to generate a control signal for controlling an operation of an electronic appliance; and a communication module detachably coupled to the module unit to receive the control signal generated from the module unit and transmit the received control signal to the electronic appliance through a communication network, wherein the communication module includes a mode select pin to select a control scheme of the module unit among the control scheme including to a UART scheme and a PWM scheme, and wherein the mode select pin outputs a high signal or a low signal according to the control scheme of the module unit.

2. The wireless control apparatus of claim 1, wherein the communication module transmits the control signal to the electronic appliance through a gateway.

3. The wireless control apparatus of claim 1, wherein the module unit includes a dimmer to control the electronic appliance including a lighting appliance, or at least one of a remote controller and a wall pad to control the electronic appliance including at least one of a home electronic appliance and various sensors.

4. The wireless control apparatus of claim 1, wherein the communication module includes a housing having an inner space; and a module substrate disposed in the inner space of the housing and on which a wireless communication chip is mounted.

5. The wireless control apparatus of claim 4, wherein the module substrate includes an antenna unit;

a wireless communication unit; and an interface unit, and wherein the interface unit makes contact with an interface of the module to receive the control signal, the wireless communication unit receives the received control signal and generates an output signal to be transmitted to the electronic appliance based on the received control signal, and the antenna unit transmits the output signal generated from the wireless communication unit to the electronic appliance.

6. The wireless control apparatus of claim 5, wherein the housing includes a first receiving part to receive the antenna unit; and a second receiving part to receive the wireless communication unit, and wherein the interface unit is inserted into an inserting hole provided in the module unit protruding out of the housing, and the first receiving part receiving the antenna unit protrudes out of the electronic appliance when the interface unit is inserted into the inserting hole of the module unit.

7. The wireless control apparatus of claim 5, wherein the interface unit includes a plurality of pins making contact with an interface of the module unit to communicate with the module unit, the pins are divided into at least first and second pin groups, and the module substrate includes a recess to allow the first and second pin groups to be spaced apart from each other.

8. The wireless control apparatus of claim 7, wherein the pins are divided into the first and second pin groups according to kinds of signals transmitted through each pin, and wherein a number of pins of the first pin group is different from a number of pins of the second pin group.

9. The wireless control apparatus of claim 7, wherein the first pin group is related to a reference voltage and the second pin group is related to the control signal.

10. The wireless control apparatus of claim 7, wherein a ground pin is disposed at a center of the pins, and wherein the first pin group and the second pin group are divided based on the ground pin.

11. The wireless control apparatus of claim 5, wherein the antenna unit is opposite to the interface unit while interposing the wireless communication unit therebetween.

12. A network system comprising:

at least one electronic appliance that receives a control signal through a communication network and is driven by the received control signal; and a wireless control apparatus to transmit the control signal to the electronic appliance through the communication network, wherein a first communication module is detachably coupled to the wireless control apparatus to determine the communication network and transmit the control signal to the electronic appliance, and a second communication module is detachably coupled to the electronic appliance to determine the communication network and receive the control signal transmitted through the wireless control apparatus, wherein the second communication module includes a mode select pin to select a control scheme of the electronic appliance among the control scheme including to a UART scheme and a PWM scheme, and wherein the mode select pin outputs a high signal or a low signal according to the control scheme of the electronic appliance.

13. The network system of claim 12, further comprising a gateway disposed between the electronic appliance and the wireless control apparatus to receive the control signal transmitted through the wireless control apparatus and to transmit the received control signal to the electronic appliance, wherein a third communication module is detachably coupled to the gateway to determine the communication network.

14. The network system of claim 13, wherein a type of the communication network used between the wireless control apparatus and the gateway is different from a type of the communication network used between the gateway and the electronic appliance.

15. The network system of claim 13, wherein each of the first to third communication modules includes a housing having an inner space; and a module substrate disposed in the inner space of the housing and on which a wireless communication chip is mounted, and wherein the module substrate includes an antenna unit;

a wireless communication unit; and an interface unit.

16. The network system of claim 15, wherein the housing includes a first receiving part to receive the antenna unit; and a second receiving part to receiving the wireless communication unit, and wherein the interface unit is inserted into an inserting hole provided in an object protruding out of the housing, and the first receiving part to receive the antenna unit protrudes out of the object when the interface unit is inserted into the inserting hole of the module unit.

17. The network system of claim 15, wherein the interface unit includes a plurality of pins which makes contact with an interface of the object to communicate with the object, the plurality of pins is divided at least into first and second pin groups, the module substrate has a recess to allow the first pin group to be spaced apart from the second pin group, and wherein the first and second pin groups are distinguished from each other according to kinds of signals transmitted through the pins.

18. The network system of claim 17, wherein a number of pins of the first pin group is different from a number of pins of the second pin group, and wherein the first pin group is related to a reference voltage and the second pin group is related to the control signal.

19. The network system of claim 17, wherein a ground pin is disposed at a center of the pins and wherein the first pin group and the second pin group are divided based on the ground pin.

20. The network system of claim 15, wherein the antenna unit is opposite to the interface unit while interposing the wireless communication unit therebetween.

* * * * *